US005103754A

United States Patent [19]

Fujitsubo

[11] Patent Number: 5,103,754

[45] Date of Patent: Apr. 14, 1992

[54] SHOCK ABSORBER FOR WATER JET SKI

[75] Inventor: Takeshi Fujitsubo, Yokohama, Japan

[73] Assignee: Prof Co., Ltd., Yokohama, Japan

[21] Appl. No.: 566,043

[22] Filed: Aug. 13, 1990

[30] Foreign Application Priority Data

Apr. 10, 1990 [JP] Japan ..... 2-95949

[51] Int. Cl.[5] ..... B63B 35/00

[52] U.S. Cl. ..... 114/270; 16/111 A; 188/316

[58] Field of Search ..... 114/270; 16/111 R, 111 A, 16/112, 113; 188/279, 280, 282, 286, 313, 316

[56] References Cited

U.S. PATENT DOCUMENTS 3,190,635 6/1965 Wustenhagen et al. ..... 188/316
4,628,579 12/1986 Taylor ..... 188/282
4,733,627 3/1988 Nishida ..... 114/270

*Primary Examiner*—Jesus D. Sotelo

*Attorney, Agent, or Firm*—Cushman, Darby & Cushman

[57] ABSTRACT

Disclosed is a shock absorber for a water jet ski which comprises a cylinder-and-piston assembly, the cylinder and piston of which are pivotably attached to a water jet ski body and to the handlebar of the water jet ski respectively. The fluid filled in the cylinder is allowed to pass through the orifices of the piston body while the piston moves back and forward in the cylinder in response to the rise and descent of the handlebar. With this arrangement the rider can move up and down the handlebar so freely as to permit him to keep his balance on the water jet ski while running on water. The orifice size is selected to be appropriate for the purpose of preventing uncontrollable quick move of the handlebar which otherwise would be caused by sudden application of strong force to the water jet ski body, thereby preventing the rider from losing his balance on the water jet ski.

9 Claims, 5 Drawing Sheets

SHOCK ABSORBER FOR WATER JET SKI

FIELD OF THE INVENTION

The present invention relates to a shock absorber which is suitable for absorbing the force which is applied to the handlebar of a water jet ski while running on water.

DESCRIPTION OF THE PRIOR ART

As is well known, a coiled spring is placed between the body and the handlebar of a water jet ski to raise and keep the handlebar in its initial raised position, thereby permitting a rider to hold his riding posture easily on the water jet ski while running on water.

The water jet ski runs on water at such a high speed that a relatively strong force is liable to be applied to the water ski body. Particularly when the water jet ski lands on water after jumping high, a strong force will be applied to the water ski body to make the handlebar to descend downwards. It is, therefore, necessary to provide means to prevent the handlebar from lowering on such occasion. As described above, a coiled spring is placed between the body and handlebar of the water jet ski. The resilient strength of the coiled spring, however, can be strong enough to raise and keep the handlebar in its initial raised position in normal condition, but cannot be enough to hold the handlebar in its raised position against the strong force which tends to push the handlebar downwards.

The resilient strength of the coiled spring can be increased in the hope of raising and holding the handlebar in its raised position at all times. This, however, can be no remedy because use of a strong resilient spring prevents a rider from moving the handlebar freely up and down for steering the water jet ski. Therefore, use cannot be made of a coiled spring whose resilient strength is strong enough to resist to the lowering of the handlebar when a strong force is applied to the water jet ski.

SUMMARY OF THE INVENTION

The object of the present invention is to provide a water jet ski whose handlebar can be moved freely up and down, still guaranteed free of uncontrollable lowering of the handlebar due to sudden application of strong force to the water ski body.

To attain this object a shock absorber for a water jet ski, the base end of which shock absorber is pivotably attached to the front of said water jet ski body, and the other end of which shock absorber is adapted to act on the handlebar of said water jet ski, is improved according to the present invention in that it comprises a hollow cylinder and a piston rod having a piston body which tightly fits in said cylinder to divide the inner space of said hollow cylinder in two variable pressure chambers, both of which are filled with a fluid, said piston body having orifices, said hollow cylinder extending between and being fixed to the vicinity of the pivot end of said handlebar and said water jet ski body.

Two variable pressure chambers communicate with each other through the orifices of the piston body. The rider can freely move the handlebar while the water jet ski is running on water at normal speed. The speed at which the rider can move the handlebar vertically can be determined by the flow rate at which the fluid can pass through the orifices per unit time. The handlebar can be prevented from descending upon sudden application of strong force to the water ski body by appropriately selecting the orifice size, and hence the flow rate of the fluid through the orifices of the piston body.

Other objects and advantages of the present invention will be understood from the following description of preferred embodiments of the present invention, which are shown in accompanying drawings.

Figure 1:
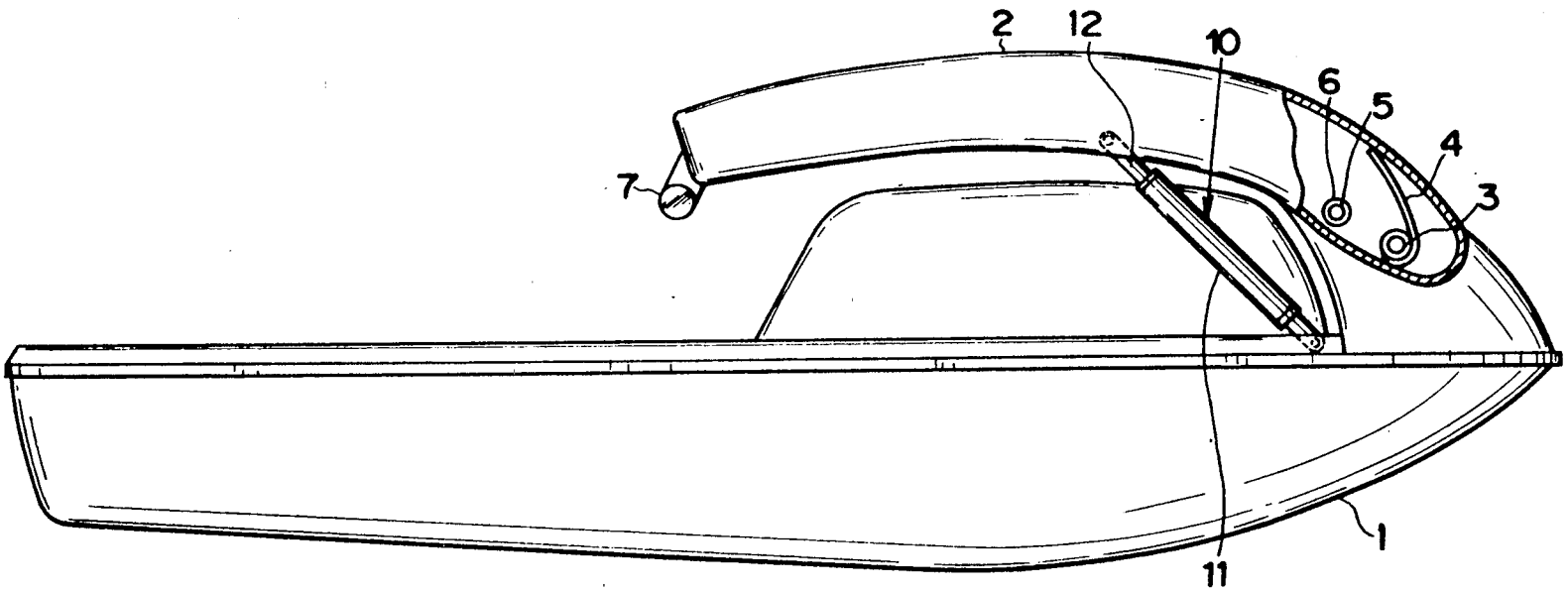
FIG. 1 is a side view of a water jet ski equipped with a shock absorber according to a first embodiment of the present invention.

Referring to FIG. 1, there is shown, partly broken, a water jet ski equipped with a shock absorber according to the present invention. As seen from the drawing, handlebar 2 is pivotably attached about its pivot 3 to water jet ski body 1. Coiled spring 4 is wound around pivot 3 to apply its resilient force against handlebar 2, thereby causing handlebar 2 to be spring-biased upwards.

Pin hole 6 is made in water jet ski body 1 and handlebar 2, and when handlebar 2 is pushed down in inoperative position as shown in FIG. 1, pin 5 is inserted in pin hole 6, thereby keeping handlebar 2 in inoperative position. In use pin 5 is removed from pin hole 6, and then handlebar 2 will be automatically raised by resilient force of coiled spring 4 to operative position.

As seen from the drawing, shock absorber 10 is installed between water jet ski body 1 and handlebar 2 according to the present invention.

Figure 2:
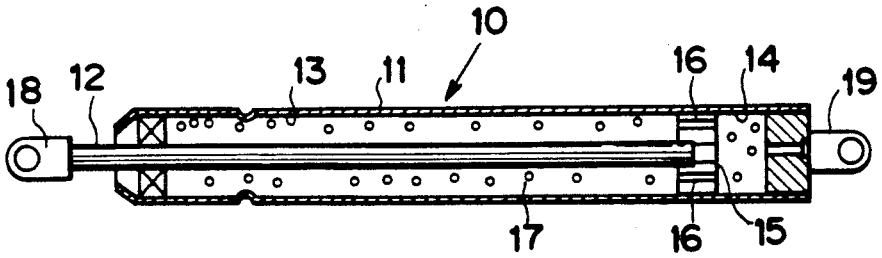
FIG. 2 is a longitudinal section of a shock absorber in its most compressive condition.

As shown in FIG. 2, shock absorber 10 comprises hollow cylinder 11 and piston rod 12 having piston body 15 which tightly fits in cylinder 11 to divide the inner space of hollow cylinder 11 in two variable pressure chambers 13 and 14. Both chambers are filled with fluid.

Piston body 15 has orifices 16. The fluid may be high-pressure gas, oil or oil-contained gas.

Shock absorber 10 is fixed to handlebar 2 by hinge 18 of piston rod 12, and to water jet ski body 1 by hinge 19 of hollow cylinder 11.

Figure 3:
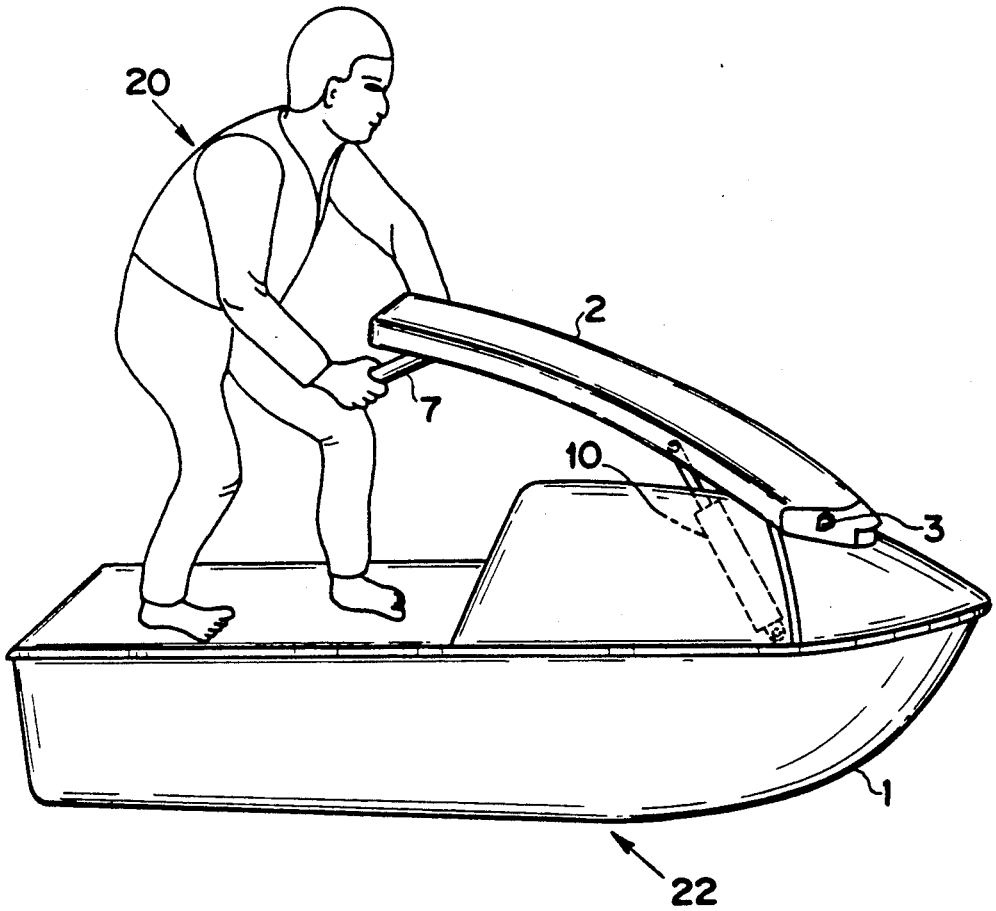
FIG. 3 shows a water jet ski running on water.
Figure 4:
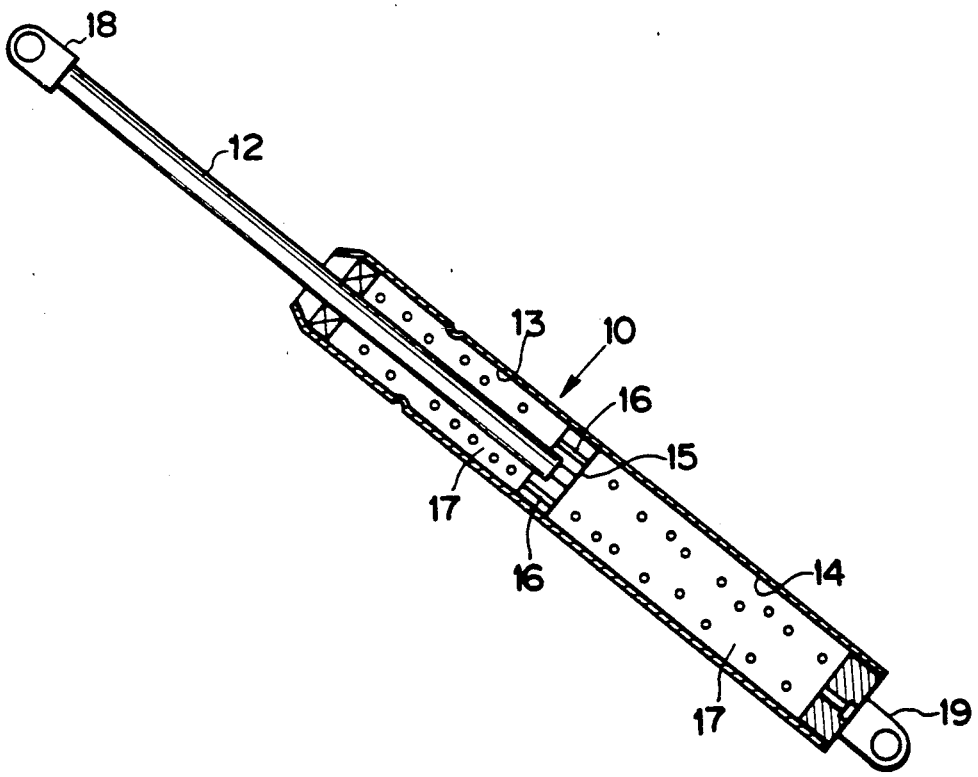
FIG. 4 is a longitudinal section of a shock absorber, showing its condition while the water jet ski is running on water.

When the water jet ski is in running position as shown in FIG. 3, shock absorber 10 has its piston body 15 at an intermediate position in hollow cylinder 11 as seen from FIG. 4. As described earlier, piston body 15 has through orifices 16 to permit the fluid to be displaced from one of pressure chambers 13 and 14 to the other when piston body 15 moves in cylinder 11. When the rider moves handle 7 up and down, handlebar 2 will be able to move accordingly without resistance.

Handlebar 2 can be moved smoothly. However, it should be noted that the orifice size which controls the flow rate of the fluid to be displaced from one to the other pressure chamber, is determined so as to prevent piston rod 12 from moving quickly. Assume that water jet ski body 1 is raised on water, causing a pull-down force to be applied to handlebar 2 as counter action. If the orifice size is determined appropriately, piston rod 12 will make a resistance against such pull-down force, thereby preventing handlebar 2 from descending. Therefore, rider 20 need not give a pull-up to handlebar in an attempt to counter the pull-down force when water jet ski body is suddenly raised on water. This favors the steering of water jet ski, allowing the rider to keep his posture with ease.

Contrary to the above, assume that water jet ski body 1 is lowered on water, causing a push-up force to be applied to handlebar 2. Then, piston rod 12 will make a resistance against such push-up, thereby preventing handlebar 2 from rising.

Figure 5:
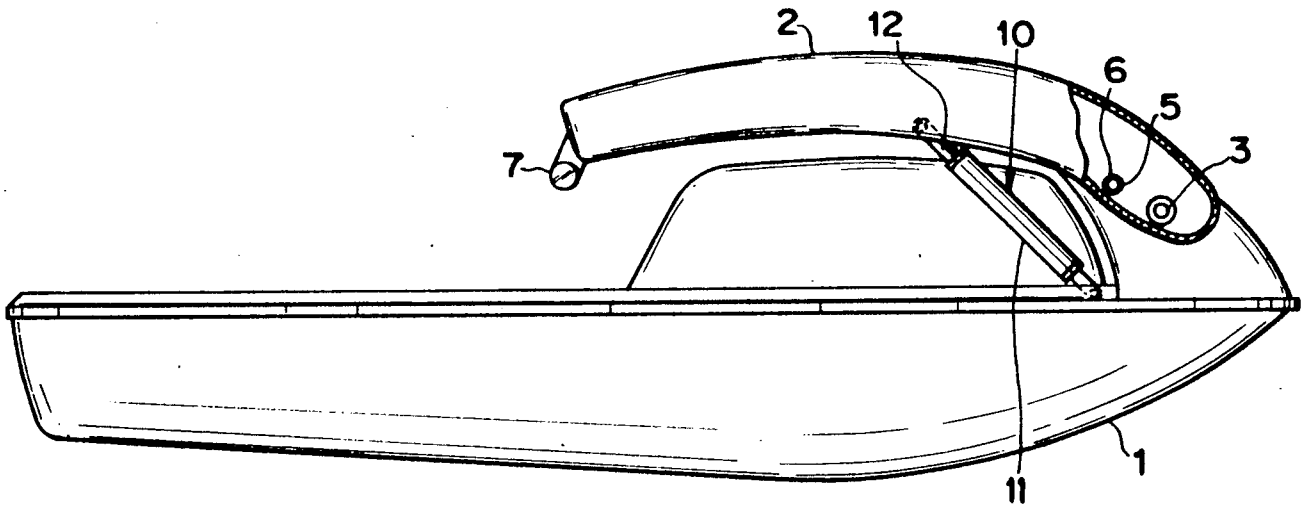
FIG. 5 is a side view of water jet ski equipped with a shock absorber according to a second embodiment of the present invention.

Referring to FIG. 5, there is shown a water jet ski equipped with a shock absorber according to a second embodiment of the present invention.

In this particular embodiment coiled spring 4 is removed, and only shock absorber 10 is used to hold handlebar 2 at a controlled position. Thus, the number of parts to make up a water jet ski is reduced, and the weight and manufacturing cost are reduced accordingly.

Figure 6:
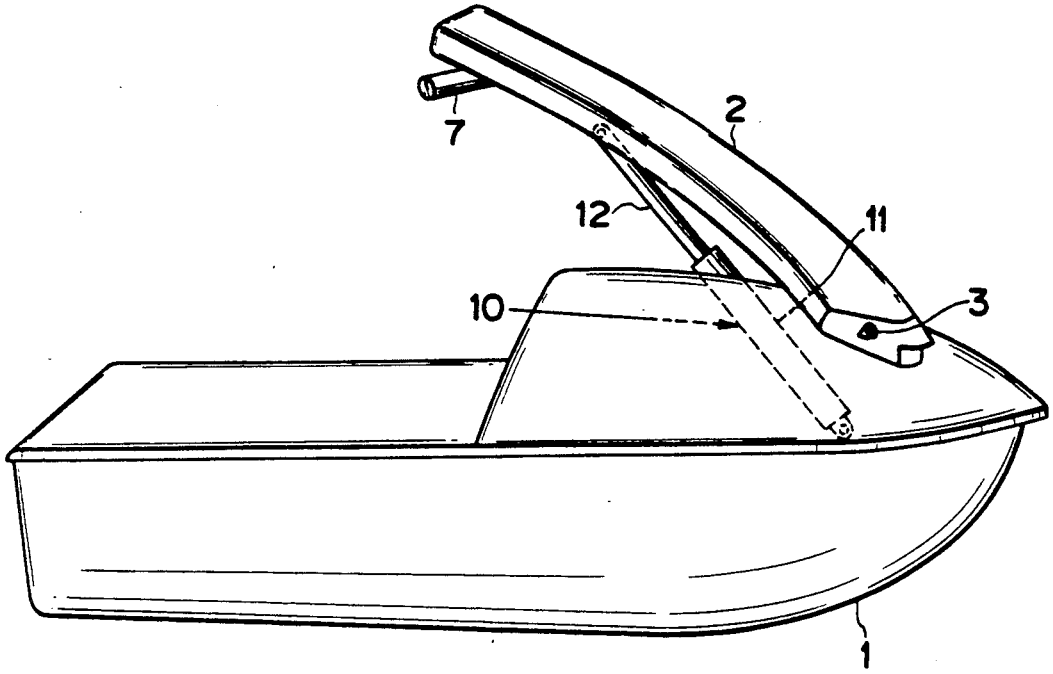
FIG. 6 is a perspective view showing a water jet ski equipped with a shock absorber according to a third embodiment of the present invention.
Figure 7:
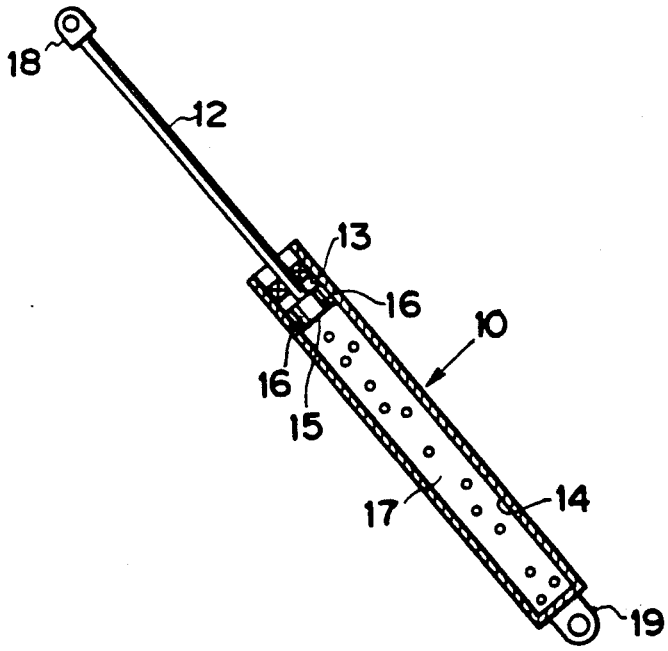
FIG. 7 is a longitudinal section of a shock absorber, showing its condition while being used.

Referring to FIGS. 6 and 7, there is shown a water jet ski equipped with a shock absorber according to a third embodiment of the present invention.

Shock absorber 10 is fixed to handlebar 2 and jet ski body 1 so as to extend to its full length in normal running position as shown in FIG. 6.

Therefore, shock can be absorbed only when a force is applied to push down handlebar 2. This one-way shock absorption makes it easy to determine orifice size in piston body 15, and therefore shock absorbers can be produced with less difficulty.

As may be understood from the above, a shock absorber according to the present invention uses a cylinder-and-piston assembly the cylinder and piston of which are pivotably attached to a water jet ski body and to the handlebar of the water jet ski respectively, allowing the fluid to pass through orifices of the piston body while the piston moves back and forward in the cylinder in response to the rise and descent of the handlebar. With this arrangement the rider can move up and down the handlebar so freely as to permit him to keep his balance on the water jet ski while running on water. The orifice size is selected to be appropriate for the purpose of preventing uncontrollable quick move of handlebar, which otherwise, would be caused by sudden application of strong force to the water jet ski body, thereby preventing the rider from losing his balance on the water jet ski.

What is claimed is:

1. Shock absorber for a water jet ski, the base end of which shock absorber is pivotably attached to the front of said water jet ski, and the other end of which shock absorber is pivotably attached to the handlebar of said water jet ski, said shock absorber comprising:

a hollow cylinder;

a piston rod, one end of which extends into said hollow cylinder;

a piston body fixed to said end of said piston rod, said piston body tightly fitting in said hollow cylinder to divide the inner space of said hollow cylinder into two variable pressure chambers, said piston body having at least one orifice therethrough for communication between said variable pressure chambers, the size of said orifice being determined so as to keep the pressures in said variable pressure chambers in balanced condition no matter what position said piston body may be put in; and, fluid occupying said variable pressure chambers.

2. Shock absorber for a water jet ski according to claim 1 wherein said fluid is a high-pressure gas.

3. Shock absorber for a water jet ski according to claim 1 wherein said fluid is an oil.

4. Shock absorber for a water jet ski according to claim 1 wherein said fluid is an oil-contained gas.

5. Shock absorber for a water jet ski according to claim 1 further comprising:

biasing means for causing said handlebar to occupy a normal running position relative to said water jet ski when said water jet ski is in use; and lock means for restraining said handlebar in a closed position when said jet ski is not in use.

6. Shock absorber for a water jet ski according to claim 5 wherein said biasing means comprises a coiled spring fixed to the pivot end of said water jet ski handlebar.

7. Shock absorber for a water jet ski according to claim 5 wherein said lock means comprises a pin and pin holes in said handlebar and said water jet ski, said holes being brought into registration and said pin being inserted therein when said handlebar is in a closed position relative to said water jet ski.

8. Shock absorber for a water jet ski according to claim 1 wherein the size of said at least one orifice in said piston body is determined so that said shock absorber alone provides sufficient resilient force between said handlebar and said water jet ski to cause said handlebar to remain in a normal running position relative to said water jet ski when said water jet ski is in use.

9. Shock absorber for a water jet ski according to claim 1 wherein said shock absorber is in a fully extended position when said handlebar is in normal running position relative to said water jet ski.

* * * * *